United States Patent [19]

Suzuki et al.

[11] Patent Number: 4,724,090

[45] Date of Patent: Feb. 9, 1988

[54] ADDITIVE FABRIC SOFTENING COMPOSITION FOR GRANULAR DETERGENT

[75] Inventors: Shigeru Suzuki, Ichikawa; Hiroshi Nakaya, Tokyo; Kiyoshi Nakayama, Chiba, all of Japan

[73] Assignee: Lion Corporation, Tokyo, Japan

[21] Appl. No.: 59,176

[22] Filed: Jun. 12, 1987

Related U.S. Application Data

[63] Continuation of Ser. No. 743,136, Jun. 10, 1985, abandoned.

[30] Foreign Application Priority Data

Jun. 20, 1984 [JP] Japan ..... 59-125364
Jun. 20, 1984 [JP] Japan ..... 59-125365

[51] Int. Cl.[4] ..... C11D 1/62; C11D 3/37; D06M 13/46

[52] U.S. Cl. ..... 252/8.75; 252/8.8; 252/174.23; 252/174.24; 252/528; 252/547; 252/DIG. 2

[58] Field of Search ..... 252/8.75, 8.8, 174.23, 252/174.24, 528, 547, DIG. 2

[56] References Cited

U.S. PATENT DOCUMENTS

| | | | |
|---|---|---|---|
| 3,703,480 | 11/1972 | Grand et al. | 252/524 |
| 4,073,735 | 2/1978 | Ramachandran | 252/8.8 |
| 4,126,563 | 11/1978 | Barker | 252/8.8 |
| 4,272,386 | 6/1981 | Draper et al. | 252/8.6 |
| 4,339,335 | 7/1982 | Wixon | 252/8.8 |
| 4,540,499 | 9/1985 | Sakatani et al. | 252/8.75 |
| 4,578,200 | 3/1986 | St. Laurent et al. | 252/8.8 |

FOREIGN PATENT DOCUMENTS

| | | |
|---|---|---|
| 2849931 | 5/1979 | Fed. Rep. of Germany . |
| 36-8927 | 6/1961 | Japan . |
| 49-98403 | 9/1974 | Japan . |
| 53-41312 | 4/1978 | Japan . |
| 55-86895 | 7/1980 | Japan . |
| 121671 | 7/1982 | Japan . |
| 6294 | 1/1984 | Japan . |
| 6296 | 1/1984 | Japan . |
| 6298 | 1/1984 | Japan . |
| 6299 | 1/1984 | Japan . |
| 59-6293 | 1/1984 | Japan . |

*Primary Examiner*—Prince E. Willis

*Attorney, Agent, or Firm*—Armstrong, Nikaido, Marmelstein & Kubovcik

[57] ABSTRACT

An additive composition for a granular detergent comprising:

(a) a cationic surfactant having the general formula (I):

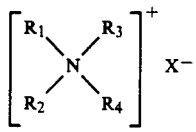

(I)

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 10 mole oxyalkylene units, and X represents a halogen atom, $CH_3SO_4$, $C_2H_5SO_4$, or

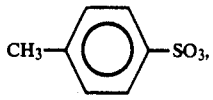

, and (b) (i) a polymer of an acrylamide monomer having the general formula (II)

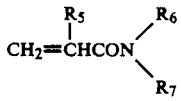

(II)

wherein $R_5$ represents hydrogen or methyl, and $R_6$ and $R_7$ independently represent hydrogen, an alkyl group having 1 to 10 carbon atoms, a hydroxy alkyl group having 1 to 10 carbon atoms, or the substituted alkyl group having 2 to 15 carbon atoms or (ii) a copolymer of the acrylamide monomer (II) with an anionic monomer. The ratio of component (a)/component (b) in a weight basis is 99.9/0.1 to 50/50.

8 Claims, No Drawings

ADDITIVE FABRIC SOFTENING COMPOSITION FOR GRANULAR DETERGENT

This is a continuation of application Ser. No. 743,136, filed 6-10-85, now abandoned.

BACKGROUND OF THE INVENTION

1. Field of the Invention

The present invention relates to an additive composition suitable for use in the compounding of a granular detergent. More specifically, the present invention relates to an additive composition for a granular detergent, especially for a granular detergent containing an anionic surfactant, capable of providing an excellent soft finish or touch in fabrics to be washed, while simultaneously washing the fabrics during a fabric laundering operation.

2. Description of the Related Art

Heretofore, when fabrics are washed at home, softening is generally afforded after washing with conventional detergents and after rinsing with a large amount of water by treating the fabrics with a softening agent containing, as a main ingredient, a cationic surfactant such as a quaternary ammonium salt. The softening agent cannot be used together with detergents since, while cationic surfactants have excellent softening and antistatic effects, they do not result in a sufficient softening when used with detergents.

Home laundering detergents generally contain anionic surfactants. Cationic surfactants added to a laundering system are attacked by such anionic surfactants in the detergents. The quaternary ammonium salts lose their ionic properties and are stably dispersed in the laundering system. Therefore, it becomes difficult for the quaternary ammonium salts to be absorbed into the fabrics.

However, separate operations of laundering and soft finishing are troublesome and time-consuming. Accordingly, it is desired by consumers to develop a detergent composition capable of simultaneously washing and softening fabrics.

Hitherto, various attempts have been made to provide sufficient softening effects in fabrics by adding cationic surfactants to detergent solutions simultaneously during fabric laundering operations. For example, it has been proposed that cationic surfactants be granulated with inorganic or organic salts or organic dispersing retardants as disclosed in Japanese Examined Patent Publication (Kokoku) No. 36-8927, U.S. Pat. No. 4073735, and Japanese Unexamined Patent Publication (Kokai) Nos. 55-86895, 53-41312, and 49-98403.

Furthermore, it has been disclosed in, for example, Japanese Unexamined Patent Publication (Kokai) No. 59-6293, to use nonionic cellulose derivative in combination with cationic surfactants.

However, the softening effects in cotton fabrics are insufficient when cationic surfactants are granulated with inorganic salts although the softening effects in synthetic fiber fabrics are improved.

Furthermore, although the softening effects even in cotton fabrics can be obtained according to the softening method set forth in Japanese Unexamined Patent Publication No. 59-6293, the use of a large amount of the softening additives is required for obtaining the desired sufficient fabric softening effects and, therefore, a further improvement is desired from the practical point of view.

SUMMARY OF THE INVENTION

Accordingly, the objects of the present invention are to eliminate the above-mentioned problems of the conventional softening technique for fabrics and to provide an additive composition for a granular detergent capable of providing an excellent soft finish and feeling in fabrics, especially even in cotton fabrics, during a fabric laundering operation.

Other objects and advantages of the present invention will be apparent from the following description.

In accordance with the present invention, there is provided an additive composition for a granular detergent comprising:

(a) a cationic surfactant having the general formula (I):

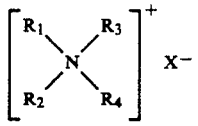

(I)

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 10 mole oxyalkylene units, and X represents a halogen atom, $CH_3SO_4$, $C_2H_5SO_4$, or

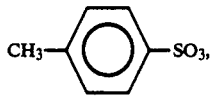

and, (b) (i) a polymer of an acrylamide monomer having the general formula (II)

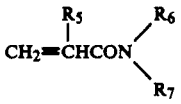

(II)

wherein $R_5$ represents hydrogen or methyl, and $R_6$ and $R_7$ independently represent hydrogen, an alkyl group having 1 to 10 carbon atoms, a hydroxy alkyl group having 1 to 10 carbon atoms, or the substituted alkyl group having 2 to 15 carbon atoms or (ii) a copolymer of the acrylamide monomer (II) with an anionic monomer. The ratio of component (a)/component (b) in a weight basis is 99.9/0.1 to 50/50.

DESCRIPTION OF THE PREFERRED EMBODIMENTS

Typical examples of the cationic surfactants (I) usable as component (a) in the present invention are quaternary ammonium salts such as distearyl dimethyl ammonium salts, dihydrogenated tallow alkyl dimethyl ammonium salts, dihydrogenated tallow alkyl benzyl methyl ammonium salts, distearyl methyl benzyl ammonium salts, distearyl methyl hydroxyethyl ammonium salts, distearyl methyl hydroxypropyl ammonium salts, and distearyl dihydroxyethyl ammonium salts.

Typical counter ions of the quaternary ammonium salts are chloride and $CH_3SO_4$. Commercially available quaternary ammonium salts generally contain lower alcohol, such as ethanol and propanol, and water. However, the contents of lower alcohols and water in quaternary ammonium salts are desirably as low as possible from the standpoint of physical properties (e.g., free flowing properties and storage stability) of the resultant granular detergent. These cationic surfactants can be used alone or in any mixture thereof.

The component (b) of the additive composition according to the present invention is a polymer of the acrylamide monomer having the general formula (II) and/or a copolymer thereof with an anionic monomer.

The acrylamide monomers having the general formula (II) include, for example, acrylamide (i.e., $R_5$, $R_6$, and $R_7$=H), methacrylamide (i.e., $R_5=CH_3$, $R_6$ and $R_7$=H), and other acrylamide monomers of the general formula (II) in which $R_5$ is H or $CH_3$ and $R_6$ and $R_7$ are independently $H_2$, alkyl groups such as $CH_3$, $C_2H_5$, $CH(CH_3)_2$, $C(CH_3)_3$, $C_8H_{17}$, and $C(CH_3)_2CH_2C(CH_3)_3$; hydroxyalkyl groups such as $CH_2OH$, $CH_2CH_2OH$, $CH_2CH_2CH_2OH$, and $CH(CH_3)CH_2OH$; and the substituted alkyl groups such as $CH_2OC_4H_9$, $CH_2OC_2H_4(CH_3)_2$, $C(CH_3)_2CH_2COCH_3$.

The polymers of the acrylamide monomer usable as component (b) (i) in the present invention are those having the general formula (III):

(III)

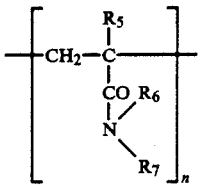

wherein $R_5$, $R_6$, and $R_7$ are as defined above and n is a number of at least 1000, preferably 10000 to 200,000. These polymers can be prepared in any conventional manner.

The anionic monomers usable in the preparation of the copolymers (b) (ii) according to the present invention include, for example, acrylic acid, methacrylic acid allyl sulfonic acid, styrene sulfonic acid, vinyl sulfonic acid, ethylene sulfonic acid, methyl propane sulfonic acid, 2-acrylamide-2-methyl propane sulfonic acid and the salts thereof (e.g. $Na^+$, $K^+$, $NH_4^+$, $Mg^{2+}$ or $Al^{3+}$ salt).

The copolymers usable as a component (b) (ii) in the present invention can be prepared by copolymerizing the acrylamide monomer and the anionic monomer in any conventional manner. However, the copolymers can be prepared by polymerizing the acrylamide monomer alone, followed by partially hydrolyzing the resultant polymer.

Although there is no specific limitation in the copolymerization ratio of the acrylamide monomer (A) to the anionic monomer (B), the preferable ratio (A)/(B) is 99.9/0.1 to 50/50, more preferably 99.5/0.5 to 75/25. When the amount of the anionic monomer is more than that of the acrylamide monomer, the desired softening effects in fabrics tend to decrease due to a reaction between the cationic surfactants and the anionic monomers. This reaction can be suppressed when the amount of the acrylamide monomer is more than that of the anionic monomer. The polymerization degree of the copolymer (b) (ii) is preferably 1000 or more, more preferably 10,000 to 200,000.

The weight ratio of the component (a) to the component (b) (i.e., (a)/(b)) in the present additive composition should be 99.9/0.1 to 50/50, desirably 99/1 to 75/25. A ratio (a)/(b) of more than 99.9/0.1 results in insufficient softening effects in cotton fabrics, whereas the ratio (a)/(b) of less than 50/50 decreases the desired softening and antistatic effects and makes the solubilizing or dispersing properties of the powder particles poor.

According to the present invention, water soluble inorganic compounds can be advantageously included in the additive compositions to improve the dispersibility of the granular additive composition in washing liquor. Typical examples of such inorganic compounds are sodium sulfate, sodium carbonate, sodium chloride, sodium silicate, sodium tripolyphosphate, sodium pyrophosphate, sodium borate, magnesium sulfate, magnesium chloride, aluminum sulfate, alum, ammonium chloride, calcium chloride, potassium chloride, potassium carbonate, and ammonium sulfate. These inorganic salts may be in the form of the anhydrous salts or hydrated salts.

The water-soluble inorganic compound (i.e., component (c)) can be suitably used in a weight ratio of ((a)+(b))/(c)=99/1 to 10/90, preferably 95/5 to 50/50. When the ratio is more than 99/1, the improvement in the dispersibility is not remarkable. Contrary to this, if a too large amount of the water-soluble inorganic compound is used, the contents of the softening agent and the detergent agent become small.

The components (a) and (b) in the present additive composition are desirably mixed as uniform as possible. The components (a) and (b) are preferably mixed together as follows. That is, the cationic surfactants are dispersed in an organic solvent or water and mixed with an aqueous solution containing 10% by weight or less of the acrylamide polymer or copolymer. The mixture was thoroughly mixed in, for example, a kneader. The mixture can be dried by heating in vacuo while mixing in a kneader. Of course, it should be noted, however, that any mixing means may be used as long as uniform mixing can be effected. For example, cationic surfactants are not necessarily dissolved in a solvent. That is, the powdered cationic surfactants having a purity of 90% or more are melted upon heating and, then, mixed with the heated aqueous solution of the acrylamide polymer or copolymer. Furthermore, the acrylamide polymer or copolymer is finely divided and, then, is added to a solution of cationic surfactants or molten cationic surfactants, and then granulated either by spraying followed by cooling or solidifying upon cooling followed by crushing.

When the water-soluble inorganic salt (c) is used as a component (c), the component (c) may be added together with the component (b).

The additive composition according to the present invention can be appropriately granulated in any conventional manner. The average diameter of the granules or powder particles of the present additive composition is desirably 500 μm or less. Too large an average diameter of the particles of the present additive composition tends to cause not only difficulties in the provision of uniform softening effects on fabrics to be washed, but also a deposition of the particles of the addition composition per se on fabrics after washing. Too small an average diameter of the particles of the present additive composition (e.g., less than 100 μm) tends to sometimes cause caking of the detergent composition. In such a case, the fine powder particles of the additive composition are suitably agglomerated with an appropriate inorganic coating agent and liquid binder.

According to the present invention, the adsorbability of the additive composition onto fabrics, especially cotton fabrics during a laundering operation can be far improved by previously mixing and granulating the cationic surfactants and the acrylamide polymer or copolymer. For this reason, even when the cationic surfactant is used in the presence of the anionic surfactant, the inherent fabric softening effects of the cationic surfactants can be advantageously exhibited.

Thus, according to the present invention, the granular detergent composition can include a surfactant (e.g., 5% to 35% by weight), a builder (e.g., 10% to 70% by weight), a fabric softening agent (i.e., the above-mentioned additive component), and, optionally, any other conventional ingredients.

The additive compositions for granular detergent according to the present invention can be incorporated into any conventional granular detergents generally in an amount of 0.1% to 20% by weight, desirably 0.5% to 10% by weight, in terms of the amount of the cationic surfactant, based on the amount of the granular detergent. An amount of the present additive composition of less than 0.1% by weight in terms of the amount of the cationic surfactant results in insufficient softening effects, whereas an amount of more than 20% by weight of the cationic surfactant decreases the detergency (or detergent power) and foaming (or lathering) characteristics of the resultant granular detergent composition.

The surfactants usable in the granular detergent composition of the present invention are those which are conventionally used in conventional granular detergent compositions. Examples of such surfactants are linear alkyl benzene sulfonate, olefin sulfonate, alkyl sulfate, alkyl ether sulfate, sulfo fatty acid or sulfo fatty ester, soap so on as anionic surfactant, or nonionic, ampholytic, zwitter ionic surfactants or any mixture thereof.

The builders usable in the granular detergent composition of the present invention are those which are conventionally used in conventional granular detergent compositions. Examples of such builders are detergency builders such as sodium tripolyphosphate, tetrasodium pyrophosphate, and zeolite, chelate builders such as sodium citrate, NTA, and EDTA, alkaline builders such as sodium silicate, sodium carbonate, and sodium bicarbonate, and the other inorganic builders such as $Na_2SO_4$, NaCl, and calcium carbonate.

The optional ingredients conventionally used in the preparation of granular detergent compositions are redeposition preventing agents such as carboxymethyl cellulose (CMC) and polyethylene glycol (PEG), enzymes, bleaching agents, optical brightening agents, coloring agents, pigments, and perfumes.

The granular detergent composition of the present invention can be produced by any conventional manner. For example, the above-mentioned builders and the other optional ingredients were added to an aqueous slurry containing surfactants so that the dry matter of the slurry is, for example, 30% to 60% by weight. The slurry is, then, sprayed into a drying column at a temperature of, for example, about 200° C. to about 500° C. from an appropriate nozzle under pressure.

The additive composition of the present invention is generally used after being incorporated into granular detergents, especially those containing as a main ingredient anionic surfactants. However, the additive composition of the present invention can be used alone without using the same in combination with granular detergents.

According to the use of the present additive composition, an excellent soft finish can be obtained in fabrics, even cotton fabrics. Furthermore, when the water-soluble inorganic compounds are used, the dispersibility of the additive composition in washing liquor can be improved.

EXAMPLE

The present invention now will be further illustrated by, but is by no means limited to, the following examples, in which all percentages are expressed on a weight basis unless otherwise specified.

Examples 1 to 9

The fabric-softening effects of various additive compositions for detergents were evaluated in the following manner.

A solution of 75% of dihydrogenated tallow alkyl dimethyl ammonium chloride (Arquad 2HT (Registered Trademark) available from Lion Akzo Co., Ltd.) and 25% of isopropyl alcohol was mixed with a 2% aqueous solution of an acrylamide polymer listed in Table 1 at a temperature of 40° C. The mixture was dried in vacuo at a temperature of 50° C. The dried product was granulated in a granulator to form powder particles having a diameter of 250 μm or less. Thus, various samples of the additive compositions of Examples 1 to 9 were obtained by using various acrylamide polymers listed in Table 1.

These additive composition samples were separately incorporated in an amount of 3% in terms of the cationic surfactant into a granular detergent having the following compositions. The additive composition of Example 1 only contains, as a control, the dihydrogenated tallow alkyl dimethyl ammonium chloride.

| Composition of granular detergent | % |
|---|---|
| Linear sodium alkylbenzene sulfonate ($C_{12}$ alkyl) | 20 |
| Sodium silicate | 10 |
| Sodium carbonate | 10 |
| Zeolite (type A, average particle diameter = 2 μm) | 15 |
| Carboxymethyl cellulose | 0.6 |
| Soap (tallow fatty acid) | 0.7 |
| Polyethylene glycol (M.W. = 6000) | 0.5 |
| Sodium citrate | 0.8 |
| Fluorescent agent | 0.5 |
| Perfume | 0.2 |
| Sodium sulfate and water | balance |

Evaluation of softening effect

The fabric-softening effects of these detergent compositions were evaluated by washing sample fabrics therewith. Sample fabrics used are as follows:

| | |
|---|---|
| Nylon tricot cloth (30 denier) | 30 g × 4 pieces |
| Acrylic jersey cloth | 90 g × 2 pieces |
| Cotton towel | 80 g × 2 pieces |
| Bleached cotton cloth | 50 g × 4 pieces |

-continued

| | |
|---|---|
| Cotton knitted cloth | 85 g × 4 pieces |

The soiled sample fabrics were first washed by the above-mentioned granular detergent in tap water (or city water) at a temperature of 60° C. for 15 minutes. The sample fabrics were then rinsed with tap water at a temperature of 60° C. three times for 3 minutes each. The sample fabrics thus pretreated were then placed into a jet type domestic electric washing machine and washed in a wash liquid containing the above-mentioned granular detergent and each additive composition of Examples 1 to 9 listed in Table 1 in tap water for 10 minutes under the conditions of a liquid temperature of 25° C., a detergent concentration of 0.13%, and a bath ratio (i.e., a ratio of the washing liquid volume to the fabrics volume) of 30, followed by spin drying for 1 minute. Then, the washed sample fabrics were rinsed with tap water at a temperature of 25° C. for 3 minutes, followed by spin drying for 1 minute. This operation was repeated once more. Thereafter, the sample fabrics were air dried for 24 hours and, then, the air dried sample fabrics were conditioned under the conditions of a temperature of 25° C. and a relative humidity (RH) of 65%.

Sample cotton towels were made from the sample fabrics obtained above and fabric-softening effects of the additive compositions listed in Table 1 were evaluated by a sensory test using a panel consisting of five members (tactile impression). The results were scored on an average as follows. The tactile impression of the same cotton towels treated in the same manner as mentioned above, except that no additive composition was used, was standardized as zero (0).

| Impression | Score |
|---|---|
| Excellently soft | 5 |
| Very soft | 4 |
| Soft | 3 |
| Fairly soft | 2 |
| Slightly soft | 1 |

The test results are shown in Table 1.

TABLE 1

| Example No. | Acrylamide Polymer: Polymer | M.W. × $10^4$ | Ratio*2 (a)/(b) | Softening effect |
|---|---|---|---|---|
| 1*1 | — | — | — | 1 |
| 2 | Polyacrylamide*3 | 500 | 75/25 | 4 |
| 3 | " | 500 | 90/10 | 3 |
| 4 | " | 200 | 75/25 | 4 |
| 5 | " | 200 | 90/10 | 3 |
| 6 | Polymethacrylamide*4 | 500 | 75/25 | 3 |
| 7 | " | 500 | 90/10 | 3 |
| 8 | " | 300 | 75/25 | 3 |
| 9 | " | 300 | 90/10 | 3 |

Note:
*1Control
*2Weight ratio of Cationic surfactant/Polyacrylamide polymer
*3$R_5$ = H, $R_6$ = H, and $R_7$ = H in the general formula (III)
*4$R_5$ = $CH_3$, $R_6$ = H, $R_7$ = H in the general formula (III)

Examples 10 to 18

The fabric-softening effects of various additive compositions for detergents were evaluated in the following manner.

A solution of 75% of dihydrogenated tallow alkyl dimethyl ammonium chloride (Arquad 2HT) and 25% of isopropyl alcohol was mixed with a 2% aqueous solution of a copolymer of an acrylamide monomer and an anionic monomer listed in Table 2 at a temperature of 40° C. The mixture was dried in vacuo at a temperature of 50° C. The dried product was granulated in a granulator to form powder particles having a diameter of 250 μm or less. The same procedure was repeated to prepare various samples of the additive compositions of Examples 10 to 18 containing various copolymers at various copolymerizing ratios and compounding ratios.

These additive composition samples were separately incorporated in an amount of 3% in terms of the cationic surfactant into a granular detergent having the compositions used in Examples 1 to 9. The additive composition of Example 10 only contained, as a control, the dihydrogenated tallow alkyl dimethyl ammonium chloride.

The fabric-softening effects of the additive compositions in Examples 10 to 18 were determined in the same manner as in Examples 1 to 9.

The results are shown in Table 2.

TABLE 2

| Example No. | Acrylamide copolymer: Anionic monomer | Copolymerization ratio*3 | Compounding ratio*4 | Fabric softening effect |
|---|---|---|---|---|
| 10*1 | — | — | — | 1 |
| 11 | Sodium acrylate | 98/2 | 75/25 | 4 |
| 12 | " | 98/2 | 90/10 | 3 |
| 13 | " | 95/5 | 75/25 | 4 |
| 14 | " | 95/5 | 90/10 | 3 |
| 15 | " | 80/20 | 90/10 | 3 |
| 16 | " | 95/5 | 90/10 | 3 |
| 17 | Sodium styrene sulfonate | 95/5 | 75/25 | 3 |
| 18 | Sodium styrene sulfonate | 95/5 | 90/10 | 3 |

Note:
*1Control
*2Copolymer of the anionic monomer with acrylamide (i.e., $R_5$, $R_6$, and $R_7$ = H in the general formula (II)) having a molecular weight of 800 × $10^4$ to 1000 × $10^4$. In Examples 11 to 15, the acrylamide was polymerized alone, followed by partial hydrolysis.
*3Copolymerizing ratio of acrylamide/anionic monomer
*4Weight ratio of cationic surfactant/acrylamide copolymer ((a)/(b))

Examples 19 to 29

The fabric-softening effects of various additive compositions for detergents and the deposition of the remaining additive composition particles on the washed fabrics were evaluated in the following manner.

A solution of 75% of dihydrogenated tallow alkyl dimethyl ammonium chloride (Arquad 2HT) and 25% of isopropyl alcohol was mixed with a 2% aqueous solution of a copolymer of an acrylamide monomer (i.e., $R_5$, $R_6$, and $R_7$=H in the general formula (II)) and sodium acrylate having a ratio of acrylamide monomer/sodium acrylate of 95/5 and a water-soluble inorganic compound listed in Table 3 at a temperature of 40° C. The mixture was dried in vacuo at a temperature of 50° C. The dried product was granulated in a granulator to form powder particles having a diameter of 250 μm or less. The same procedure was repeated to prepare various samples of the additive compositions of Examples 19 to 29 containing various inorganic compounds at various compounding ratios. The ratio of the component (a) to the component (b), i.e., (a)/(b) was 90/10.

These additive composition samples were separately incorporated in an amount of 2% in terms of the cationic surfactant into the granular detergent having the compositions used in Examples 1 to 9. The additive composition of Example 19 only contained, as a control, the dihydrogenated tallow alkyl dimethyl ammonium chloride. Furthermore, the additive composition of Example 20 contained the dihydrogenated tallow allyl dimethyl ammonium chloride and the acrylamide copolymer.

The fabric-softening effects of the additive compositions in Examples 19 to 29 were evaluated in the same manner as in Examples 1 to 9. The results are shown in Table 3.

Furthermore, the particle deposition test was carried out as follows. Thus, the amount of the deposition of the additive composition particles on the washed fabrics was evaluated by washing the following sample fabrics with the above-mentioned mixture of granular detergent and additive compositions.

| | |
|---|---|
| Black nylon slip | 80 g × 2 pieces |
| Black acrylic sweater | 180 g × 2 pieces |
| Blue cotton knitted shirt | 100 g × 5 pieces |

The soiled sample fabrics were placed in a jet type domestic electric washing machine and were washed by using the above-mentioned granular detergent, the additive compositions, and tap water at a temperature of 5° C. under the conditions of a detergent concentration of 0.26% and a bath ratio of 30 for 5 minutes. Then, the washed sample fabrics were rinsed with tap water at a temperature of 5° C. twice each for 3 minutes, followed by dewatering. The amounts of the particles deposited on the washed fabrics were visually evaluated under the following evaluation standards:

| | |
|---|---|
| No particle deposition | ++ |
| No appreciable particle deposition | + |
| Somewhat particle deposition | ± |
| Remarkable particle deposition | − |

The test results are shown in Table 3.

TABLE 3

| Example No. | Water Soluble Inorganic Compound: Inorganic compound | Ratio*3 | Particle deposition | Fabric-softening effect |
|---|---|---|---|---|
| 19*1 | — | — | ++ | 1 |
| 20*2 | — | — | ± | 3 |
| 21 | $CaCl_2$ | 90/10 | + | 3 |
| 22 | $CaCl_2$ | 75/25 | + | 3 |
| 23 | $CaCl_2$ | 50/50 | ++ | 4 |
| 24 | $MgSO_4$ | 75/25 | + | 3 |
| 25 | $MgSO_4$ | 50/50 | + | 3 |
| 26 | $Na_2CO_3$ | 75/25 | + | 3 |
| 27 | NaCl | 75/25 | + | 3 |
| 28 | Sodium borate | 75/25 | + | 3 |
| 29 | $K_2SO_4$ | 75/25 | + | 3 |

Note:
*1Control (Cationic surfactant)
*2Reference Example (Cationic surfactant + Copolymer)
*3Weight ratio of (Cationic surfactant + copolymer)/inorganic compound

What is claimed is:

1. An additive composition for a granular detergent comprising:

(a) a cationic surfactant having the general formula (I):

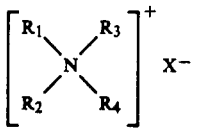

(I)

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 10 mole oxyalkylene units, and X represents a halogen atom, $CH_3SO_4$, $C_2H_5SO_4$, or

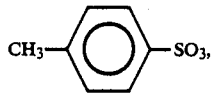

and (b) (i) a polymer of an acrylamide monomer having the general formula (II)

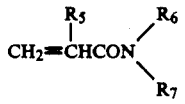

(II)

wherein $R_5$ represents hydrogen or methyl, and $R_6$ and $R_7$ independently represent hydrogen, an alkyl group having 1 to 10 carbon atoms, a hydroxy alkyl group having 1 to 10 carbon atoms, or the substituted alkyl group having 2 to 15 carbon atoms or (ii) a copolymer of the acrylamide monomer (II) with an anionic monomer, the ratio of component (a)/component (b) in a weight basis being 99.9/0.1 to 50/50, and (c) a water-soluble inorganic compound.

2. An additive composition as claimed in claim 1, wherein the polymer of the acrylamide monomer has the general formula (III):

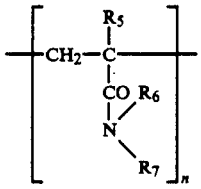

(III)

wherein $R_5$, $R_6$, and $R_7$ are as defined above and n is a number of at least 1000.

3. An additive composition as claimed in claim 1, wherein the copolymerization ratio of the acrylamide monomer to the anionic monomer is 99.9/0.1 to 50/50.

4. An additive composition as claimed in claim 1, wherein the cationic surfactant is at least one quarternary ammonium salt selected from the group consisting of dihydrogenated tallow alkyl dimethyl ammonium chloride, distearyl dimethyl ammonium chloride, dihydrogenated tallow alkyl benzyl methyl ammonium chloride, dihydrogenated palmoil alkyl dimethyl ammonium chloride, and the $CH_3SO_4$ salts of the above-mentioned cations.

5. An additive composition as claimed in claim 1, wherein the weight ratio of component (a)/component (b) is 99/1 to 75/25.

6. An additive composition as claimed in claim 1, wherein the water-soluble inorganic compound is at least one compound selected from the group consisting of sodium sulfate, sodium carbonate, sodium chloride, sodium silicate, sodium tripolyphosphate, sodium pyrophosphate, sodium borate, magnesium sulfate, magnesium chloride, aluminium sulfate, alum, ammonium chloride, calcium chloride, potassium chloride, potassium carbonate, and ammonium sulfate.

7. A granular detergent composition for simultaneously washing and soft-finishing fabrics comprising a surfactant, a builder, and a fabric softening agent, said fabric softening agent comprising (a) a cationic surfactant having the general formula (I):

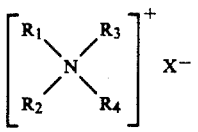

(I)

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 10 mole oxyalkylene units, and X represents a halogen atom, $CH_3SO_4$, $C_2H_5SO_4$, or

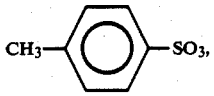

and (b) (i) a polymer of an acrylamide monomer having the general formula (II)

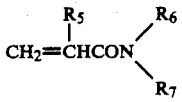

(II)

wherein $R_5$ represents hydrogen or methyl, and $R_6$ and $R_7$ independently represent hydrogen, an alkyl group having 1 to 10 carbon atoms, a hydroxyl alkyl group having 1 to 10 carbon atoms, or the substituted alkyl group having 2 to 15 carbon atoms or (ii) a copolymer of the acrylamide monomer (II) with an anionic monomer, the ratio of component (a)/component (b) in a weight basis being 99.9/0.1 to 50/50.

8. A granular detergent composition comprising a surfactant, a builder, and the additive composition of claim 1.

* * * * *